United States Patent [19]

Mayer

[11] 4,233,794

[45] Nov. 18, 1980

[54] ADJUSTABLE CONNECTING MEANS FOR CEILING CONSTRUCTIONS AND THE LIKE

[75] Inventor: Ben Mayer, Los Angeles, Calif.

[73] Assignee: Envel Corporation, Los Angeles, Calif.

[21] Appl. No.: 970,274

[22] Filed: Dec. 18, 1978

[51] Int. Cl.[3] ..... E04B 5/52; E04B 1/343

[52] U.S. Cl. ..... 52/484; 52/82; 403/4; 403/171

[58] Field of Search ..... 52/489, 488, 484, 81, 52/82; 403/171, 174, 176, 214, 4; 135/20 R, 28 R, 36 RT, 25 R

[56] References Cited

U.S. PATENT DOCUMENTS

| | | | |
|---|---|---|---|
| 1,885,781 | 11/1932 | St. John | 52/82 |
| 2,682,235 | 6/1954 | Fuller . | |
| 3,017,893 | 1/1962 | Greenbie | 52/82 |
| 3,139,958 | 7/1964 | DeWitt | 52/82 |
| 3,475,768 | 11/1969 | Burton . | |
| 3,763,608 | 10/1973 | Chamlee . | |
| 3,807,101 | 4/1974 | Cole . | |
| 3,835,602 | 9/1974 | Tuuri . | |
| 4,023,582 | 5/1977 | Buzzella et al. | |

FOREIGN PATENT DOCUMENTS

| | | | |
|---|---|---|---|
| 318951 | 9/1929 | United Kingdom | 52/82 |
| 900902 | 7/1962 | United Kingdom | 52/81 |

*Primary Examiner*—John E. Murtagh

*Attorney, Agent, or Firm*—Poms, Smith, Lande & Rose

[57] ABSTRACT

An adjustable connecting means for structural members of a suspended ceiling construction which is supported at least at its periphery and at its center and is capable of self-adjustment for ceilings of concave, convex, and horizontal configuration. A connecting means in which the edge portion of a central support member is provided with a plurality of open ended slots, the edge portion and slots being cooperable with a plurality of longitudinal structural members each having a vertically disposed web provided with flanges on opposite sides thereof, one end of the web having a sector shaped opening for reception of the edge portion and entry of a web portion inwardy of the sector shaped opening into a slot. Interengagement of the edge portion of the central support member and the adjacent end of the longitudinal structural member with a sector shaped opening interlocks the two members, provides fulcrums for relative angular movement of the two members and cooperate in such a manner that relative lateral movement between the two members is restricted, relative longitudinal movement of the two members is restricted in one direction, and relative movement between the two members in a vertical direction or in the plane of the web of the longitudinal structural member is permitted to provide a selected angular relation of the two members in accordance with the design of the suspended ceiling construction. Securement means are provided for securing the edge portion of the central support member to the longitudinal structural member in a selected relation.

7 Claims, 17 Drawing Figures

Fig. 7.
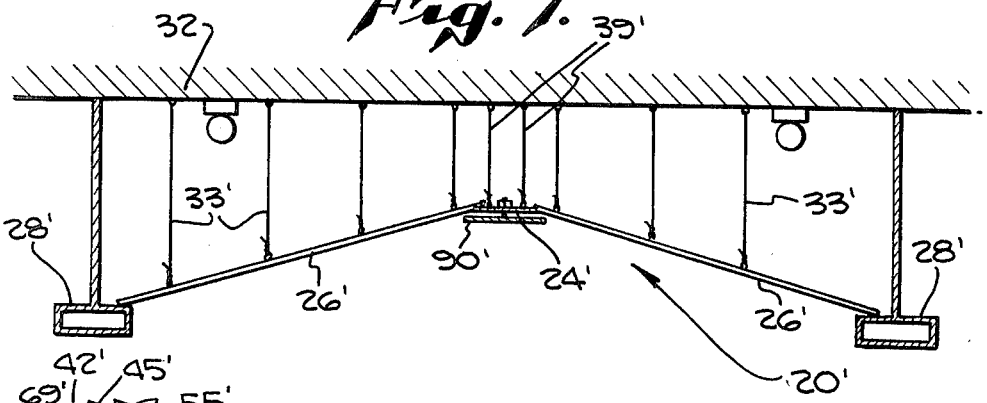
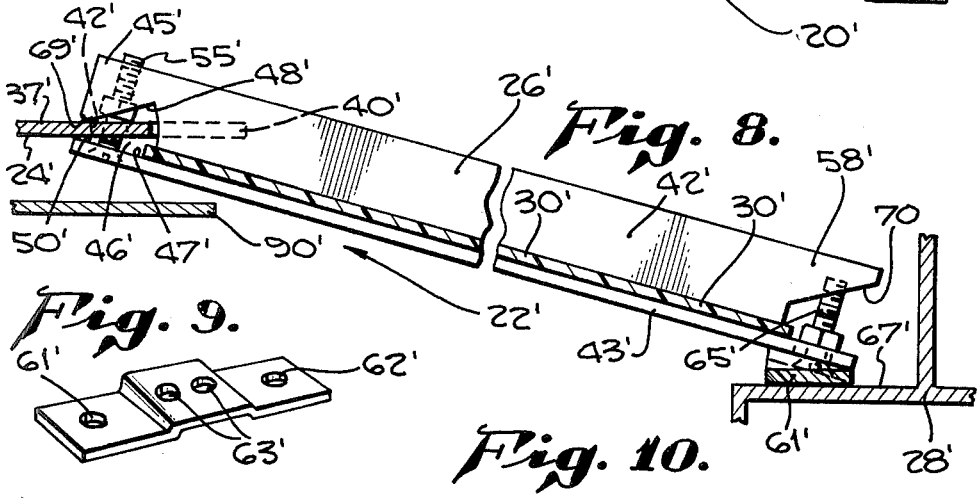
Fig. 8.
Fig. 9.
Fig. 10.
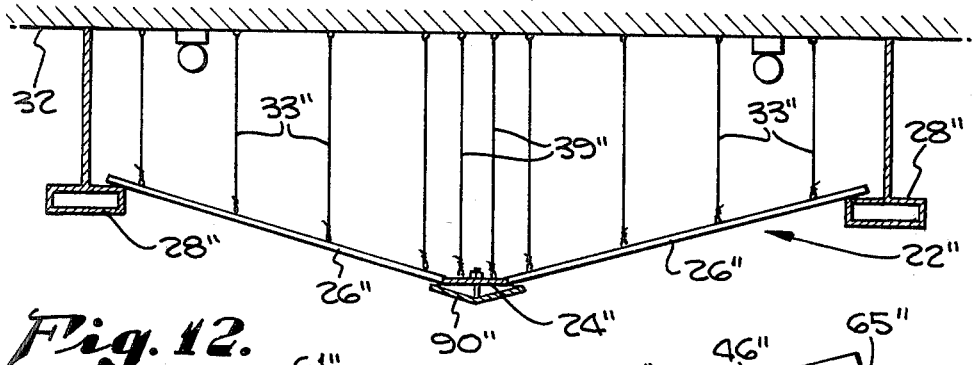
Fig. 12.
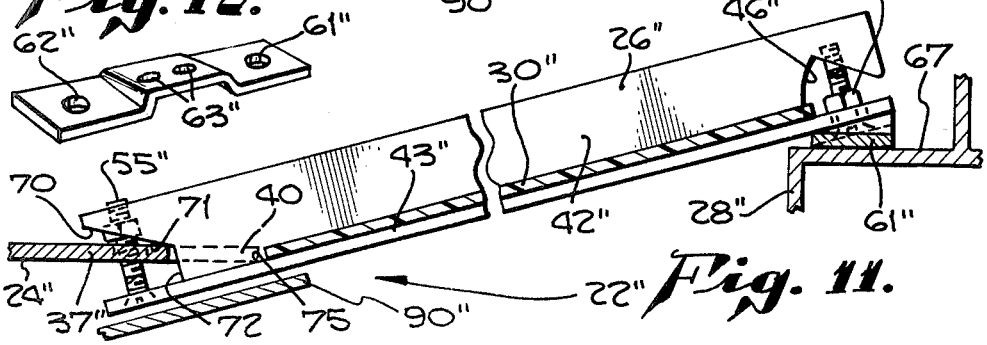
Fig. 11.

ADJUSTABLE CONNECTING MEANS FOR CEILING CONSTRUCTIONS AND THE LIKE

BACKGROUND OF THE INVENTION

This invention relates generally to decorative ceiling constructions in which a suspended framework of ceiling structural members serve to support decorative panels to provide unique aesthetic effects in the room below. The invention broadly relates to a connecting means for two structural members which may be utilized in a variety of ceiling or building constructions.

Prior proposed decorative ceiling constructions have included relatively complex framework arrangements in order to accommodate decorative panels of different shape and form. Such ceiling frameworks included a lattice-work with various shaped openings and usually arranged in horizontal planes. When a ceiling construction of convex or concave configuration was desired, such prior ceiling frameworks became complex and difficult to accurately assemble because of angular relationship of adjacent members of the ceiling framework. Thus, suspended decorative ceilings other than horizontally arranged required increased time for installation and accordingly became costly and expensive.

Such prior proposed suspended ceiling constructions required that the ceiling framework be fabricated and installed in its final position and therefore close and accurate coordination was required in the assembly of the various parts of the ceiling construction.

SUMMARY OF INVENTION

The present invention contemplates a novel connecting means for adjacent structural members to be interconnected wherein the assembly and fabrication of the suspended ceiling construction is facilitated and the disadvantages of prior ceiling constructions are substantially obviated. The present invention contemplates a suspended ceiling construction in which the novel connecting means of the invention readily permits the installation of suspended ceilings in a horizontal arrangement and particularly in convex or concave configuration. The invention contemplates a novel method of installing such a suspended ceiling construction.

The primary object of the present invention, therefore, is to provide a connecting means for structural members of a suspended ceiling construction wherein the structural members may be readily interconnected in selected angular relation.

An object of the invention is to provide a connecting means adapted to be readily interengaged in an initial position and then one of the members moved to its selected final position whereby the several structural members in the ceiling construction are readily adjusted into their final structural position.

Another object of the present invention is to provide a novel connecting means for a suspended ceiling construction wherein the angular relation of the structural members may be readily varied and selected.

A further object of the present invention is to provide a novel connecting means for a ceiling construction in which decorative panels of selected shape and size may be readily installed after the configuration of the ceiling is determined.

A specific object of the invention is to provide a connecting means in which interconnecting structural members are provided relative movement about a fulcrum on one member, are provided restricted relative lateral movement and are provided restricted relative longitudinal movement of one of the members in one direction, and wherein means are provided for securing the structural members in a selected relationship.

A further object of the invention is to provide a method of erecting a suspended ceiling construction wherein a central structural member is initially suspended at a preselected height, a longitudinally extending structural member is interengaged at one end with said central structural member and supported at the other end on a ledge at a preselected height, and wherein the central member is vertically moved to a selected final height in which the central member and the longitudinal member become angularly related with respect to a fulcrum on one of the members, and wherein the members are secured in such final selected position.

A still further object of the present invention is to provide a connecting means which is readily adaptable for use in a geodesic dome construction, the connecting means being utilized for connecting structural members to a plurality of hubs to provide a plurality of triangular openings characteristic of a geodesic construction.

Various other objects and advantages of the present invention will be readily apparent from the following description of the drawings in which exemplary embodiments of the invention are shown.

IN THE DRAWINGS

FIG. 7 is a schematic view of a suspended ceiling construction embodying the connector means of this invention arranged to form a dome-like or concave ceiling.

FIG. 8 is an enlarged fragmentary sectional view taken in a plane similar to FIG. V—V but in the concave ceiling shown in FIG. 7 to show the connecting means of this invention.

FIG. 9 is a perspective view of a connector plate shown in FIG. 8.

FIG. 10 is a schematic view of a ceiling construction embodying the connecting means of this invention, the ceiling being convex.

FIG. 11 is an enlarged fragmentary sectional view taken in a plane similar to FIG. 5 but in the convex ceiling shown in FIG. 10.

FIG. 12 is a perspective view of a connector plate used in FIG. 11.

DETAILED SPECIFICATION

Figure 1:
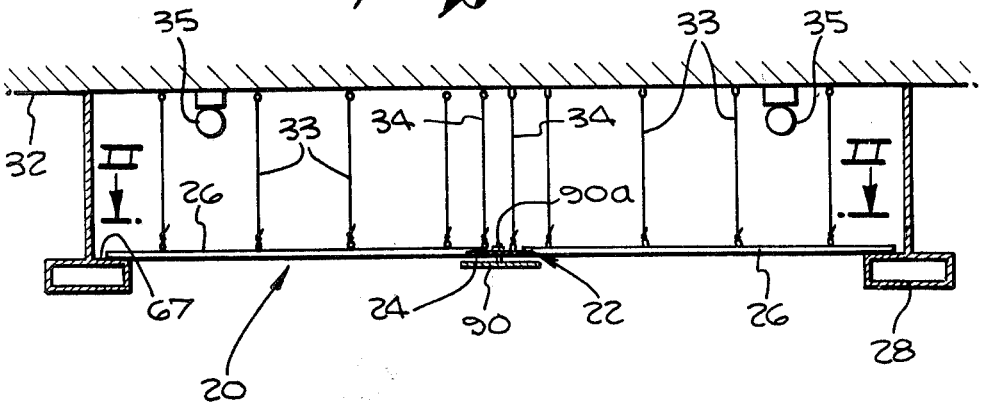
FIG. 1 is a schematic view of a decorative suspended ceiling construction embodying the connecting means of this invention, the ceiling construction lying in a horizontal plane.
Figure 2:
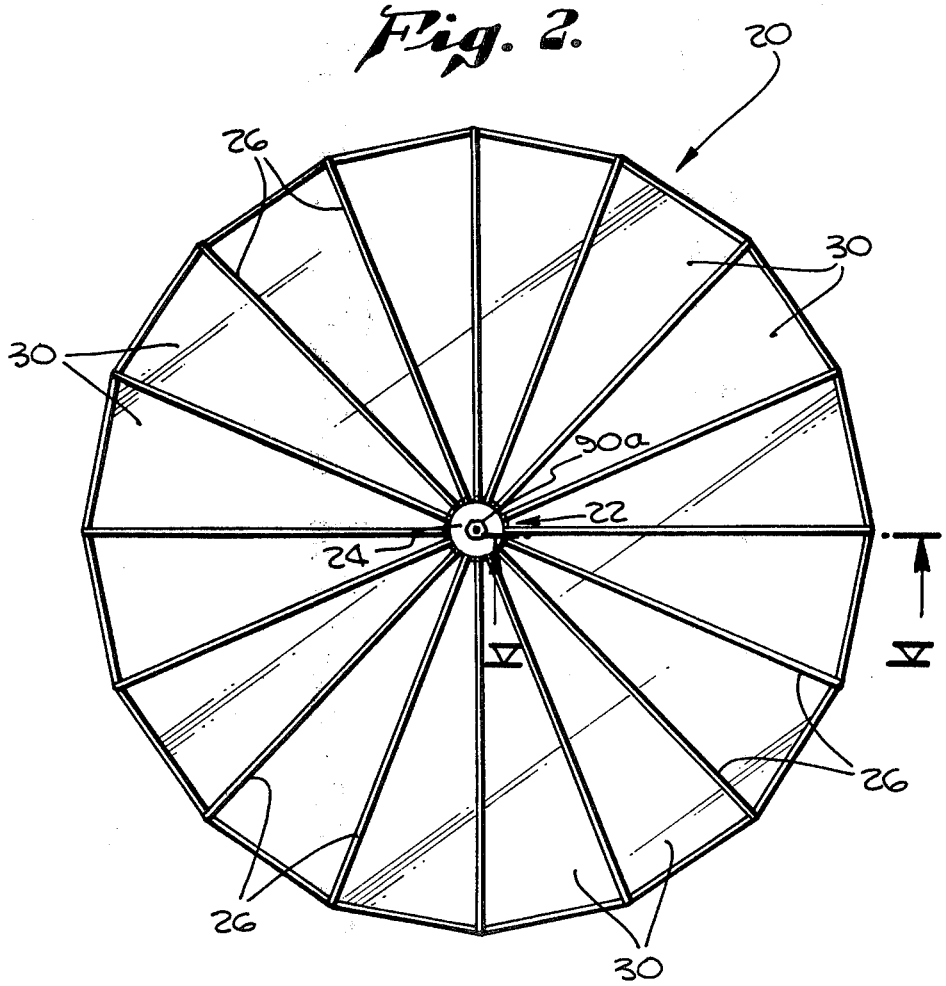
FIG. 2 is a top view of the ceiling construction shown in FIG. 1 as taken from the plane indicated by line II—II of FIG. 1.

In FIGS. 1–6, a ceiling construction generally indicated at 20 embodying the connecting means 22 of this invention is shown, the ceiling construction 20 being disposed in a horizontal plane to illustrate one example of a decorative suspended ceiling construction to which the connecting means 22 of the invention is adapted. Two other exemplary illustrations of a suspended ceiling construction utilizing connecting means 22 of the invention are shown in FIGS. 7 and 10 and demonstrate the adaptability of the connecting means of this invention.

In general, suspended ceiling construction 20 comprises a central support member 24, a plurality of outwardly extending longitudinal structural members 26, a peripheral support means 28, and decorative panels 30 supported from the longitudinal structural members 26. Such a ceiling construction 20 may be spaced a selected distance below a primary or main ceiling structure 32 from which peripheral support members 28 depend in a suitable arrangement. Longitudinal members 26 may be suspended from the primary ceiling 32 by suitable suspension wires 33 secured at their upper ends to the ceiling 32 and adjustably secured at their lower ends to longitudinal members 26. Similarly, the central support member 24 may be suspended from ceiling 32 by suitable suspension wires 39. Attached to ceiling 32 in suitable spaced relation are a plurality of lighting fixtures 35 which illuminate the transparent or translucent panels 30 for lighting the room below the suspended ceiling. Panels 30 may be made of suitable decorative material of different colors and patterns in order to create a desired aesthetic lighting effect in the room below.

In this example, central support member 24 may comprise a circular metal disc of selected diameter and having an annular edge portion 37. Support member 24 includes angularly spaced eyelets 38 inwardly of edge portion 37 for connection of suspending wires 39.

Connecting means 22 of this invention, best shown in FIGS. 3, 5, 8, 11, and 15 includes the provision of a plurality of angularly spaced radially extending open ended slots 40 in edge portion 37, each slot 40 providing a radial innermost slot wall 41. Edge portion 37 also includes, with respect to each slot 40, a pair of spaced radially inwardly elongated bolt holes 42 to permit suitable play or tolerance for a securement bolt 55 as later described.

In this example, a plurality of longitudinal structural members 26 extend radially from central support member 24. Each structural member 26 may comprise an inverted T section having a vertically disposed web 42 and flanges 43 extending from the web on opposite sides thereof and lying in plane normal to web 42. Structural member 26 may be made of any suitable material such as a lightweight aluminum extruded alloy.

Connecting means 22 also includes the radial inward end of T section member 26. At the inner end 45 of each member 26, vertical web 42 is provided with a sector shaped opening 46. One side of sector shaped opening 46 is formed by the top surface 47 of flanges 43. The opposite side of opening 46 is formed by an inclined or diagonal edge 48 which intersects end edge 49 of web 42 to provide an opening 50 with the top surface 47 of sufficient width to loosely receive the thickness of central support member 24 at its peripheral edge portion 37. Inner edge 52 of opening 46 may be formed on a selected arc, the included angle of which may be 30°. The selected included angle may vary from 30° and determines the maximum angular relationship to be permitted between the central support member and longitudinal member 26. Thus, in the example described, the selected angular relation between the support member 24 and the longitudinal members 26 may vary between 0° to 30°, the example shown in the first embodiment of the invention illustrating an angular relation of 0°.

Figure 3:
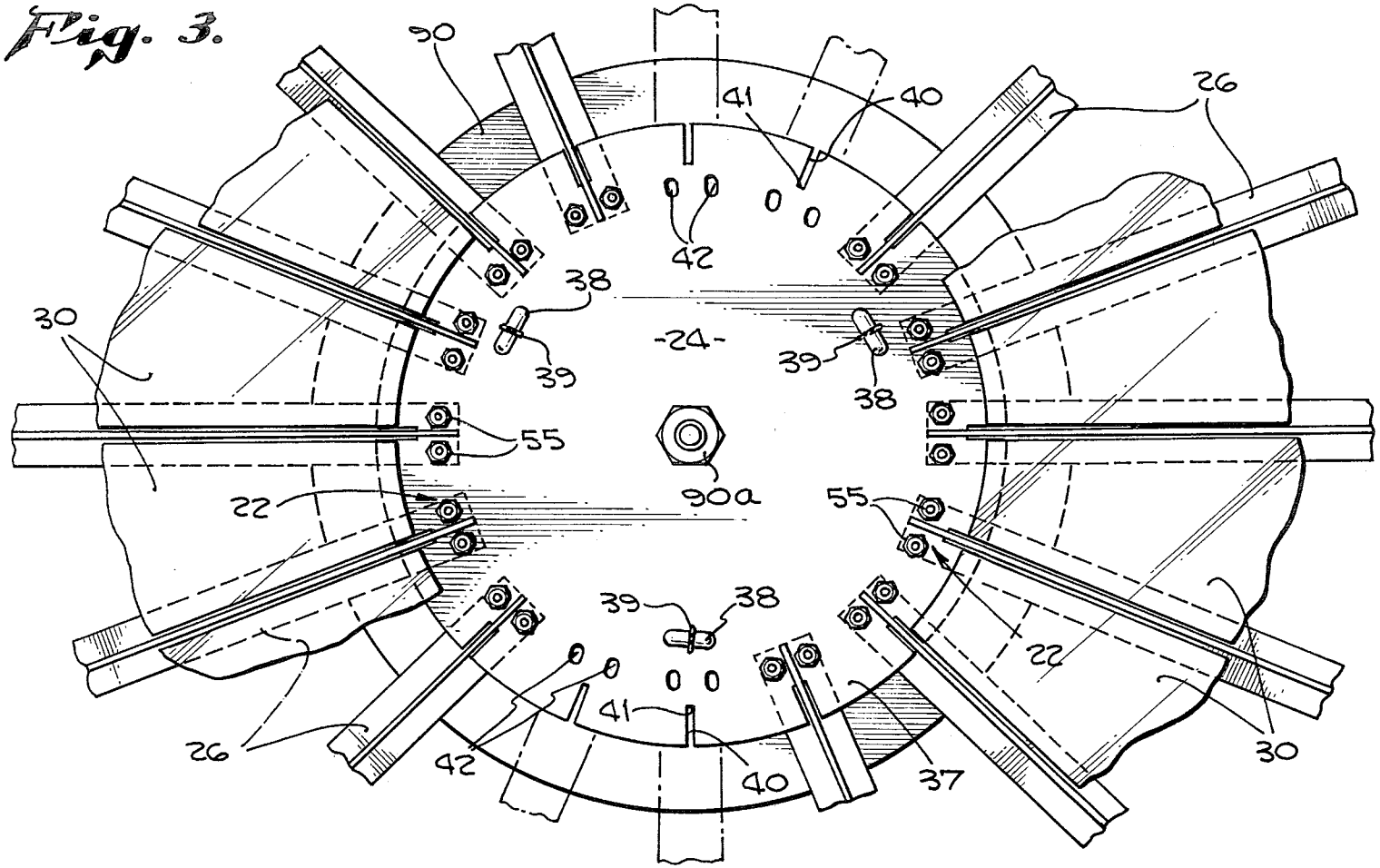
FIG. 3 is an enlarged fragmentary view of the central portion of the ceiling construction shown in FIG. 1 and showing the connecting means of this invention.
Figure 4:
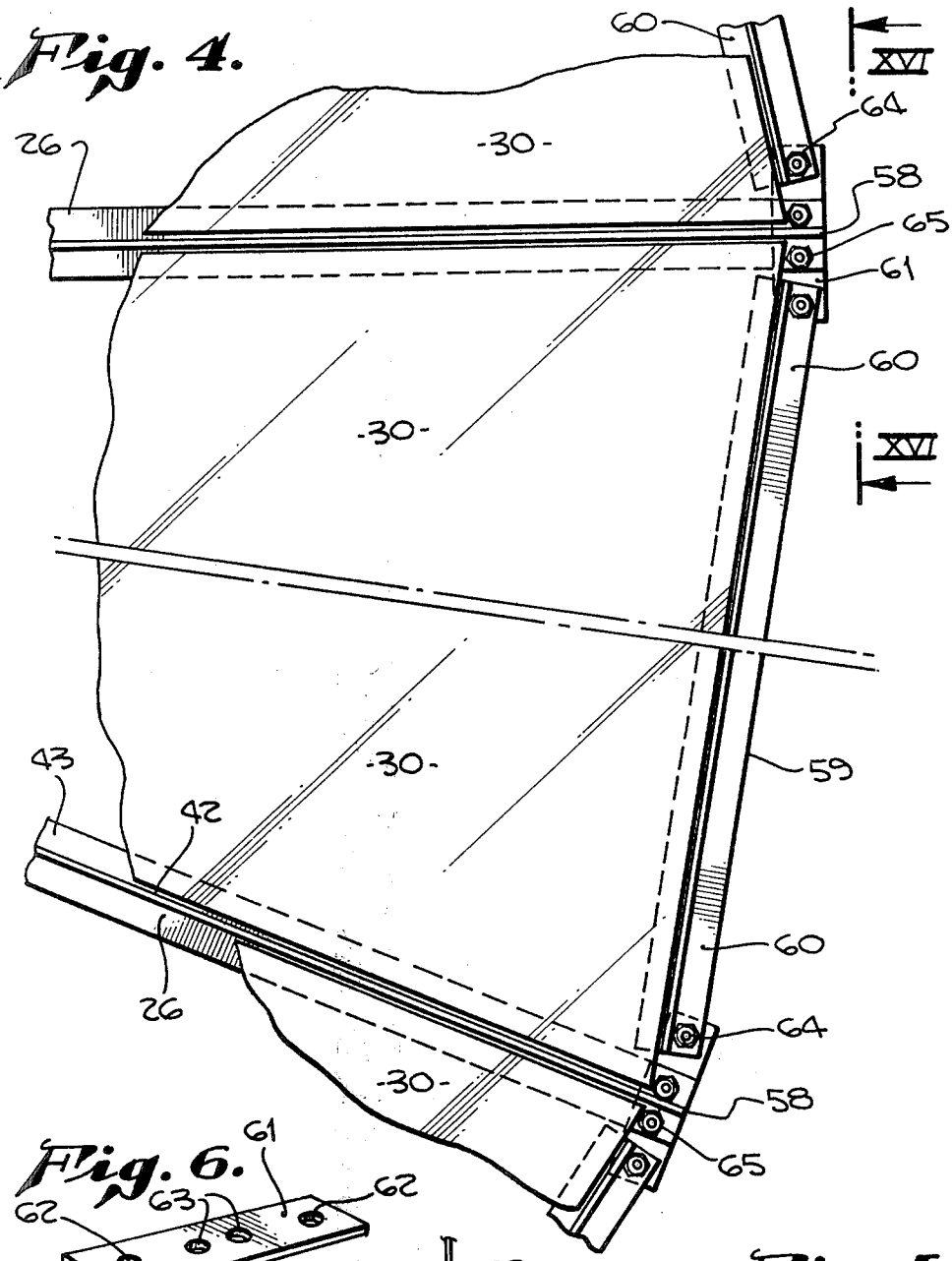
FIG. 4 is an enlarged fragmentary view of a peripheral edge portion of the ceiling construction shown in FIG. 1.
Figure 6:
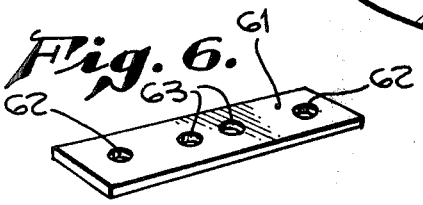
FIG. 6 is a perspective view of a connector plate used in the ceiling construction shown in FIG. 4.
Figure 5:
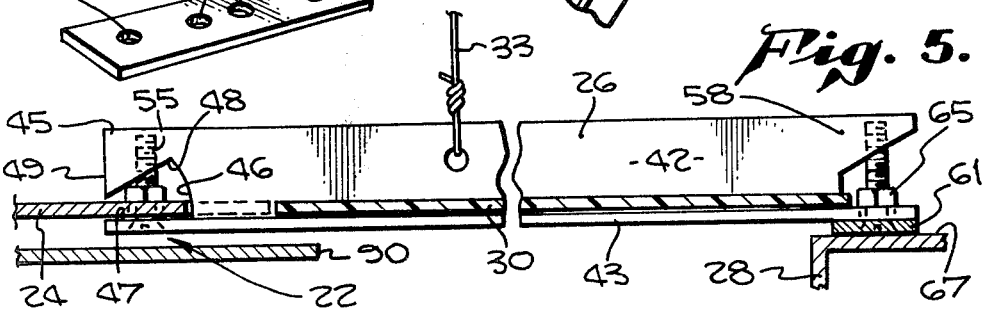
FIG. 5 is a fragmentary enlarged sectional view taken in the plane indicated by line V—V of FIG. 2.

From a consideration of FIGS. 3 and 5, assembly of longitudinal members 26 with central member 24 is readily accomplished by reception of edge portion 37 of the disc through opening 50 of the sector shaped slot in web 42 with web 42 in alignment with a slot 40. Slot 40 thus embraces web portions of web 42 inwardly of arcuate wall 52 of sector shaped opening 46 and the slot edge wall 41 is moved into a loose tolerance relationship with the arcuate edge wall 52 of the opening 46. In this relation it will be apparent that web 42 and flanges 43 become interlocked with edge portion 37 of central member 24 and are restrained against relative lateral movement, against movement of member 26 relative to central member 24 in one direction; namely, toward member 24, and are permitted relative movement in a vertical direction of the support member and structural member; that is, in the plane of web 42.

Flanges 43 at end portion 45 are provided with bolt holes 54 adapted to receive securement screw bolt and nut assemblies 55, holes 54 being alignable with elongated holes 42 in edge portion 37. When the angular relation between the support member 24 and longitudinal member 26 is 0°, the bolt assembly 55 may be readily tightened to the position shown in FIG. 5.

As shown in FIGS. 1 and 5, each longitudinal member 26 may be supported by suspension wires 33 suitably connected at spaced intervals to the vertical web 42 of each member 26.

At the outer periphery of the suspended ceiling construction 20 of this invention outer end portions 58 of adjacent diverging longitudinal structural members 26 may be connected together by an inverted elongated T section member 59. Adjacent end portion 60 of elongated member 59 and end portion 58 of structural member 26 may be interconnected by a rectangular flat plate 61, FIG. 6. Connector plate 61 is provided with suitably spaced bolt holes 62 and 63, bolt holes 62 serving to receive nut and bolt assemblies 64 for connecting and securing plate 61 to adjacent ends of peripheral structural members 59 and bolt holes 63 serving to receive bolt and nut assemblies 65 for securing flanges 43 of longitudinal structural members 26 to the plate 61.

As schematically shown in FIG. 1, outer ends of structural members 26 may rest upon a ledge surface 67 provided on suspension ceiling member 28. Suspension ceiling member 28 may generally follow the periphery or circumferential outer portion of the suspended ceiling 20 in order to provide suitable support for outer margins of the suspended ceiling 26. Decorative panels 30 are provided with a polygonal shape corresponding to the shape defined by adjacent longitudinal structural members 26, peripheral structural member 59 and the edge portion 37 of the central support member. Panels 30 are suitably supported on flanges 43 and the flanges on member 59 without securement thereto if secured. Decorative panels 30 may be made of any suitable material such as various compositions of colored or tinted translucent and diffused plastics to achieve a desired aesthetic illumination effect in the room below. Decorative panels 30 include various selected patterns or designs. Inner ends of panels 30 may extend beyond the circumferential edge of central member 24.

For further aesthetic purposes, a circular cover plate 90 may be secured to and below central member 24 by an axial bolt and nut assembly 90*a*. Cover plate 90 has a diameter greater than member 24 to extend beyond and cover the edge of central member 24 and thus hide constructional details.

In FIGS. 7–9 inclusive, there is illustrated a suspended decorative ceiling construction 20' in which the central support member 24' and the longitudinally extending structural members 26' have been assembled to provide a dome or concave shaped ceiling construction to particularly illustrate the novel connecting means 22 of this invention. As best shown in FIG. 8, the central support member 24' has been assembled with the inner radial end 45' of longitudinal member 26' with the members in angular relation. Edge portion 37' of support member 24' lies intermediate edge 48' and top surface 47' of flanges 43' which define sector shaped openings 46'. Web 42' is interlocked within the slot 40' and bolt and nut assemblies 55 are accommodated in elongated openings 42' to permit the angular relation of member 26' and 24' as shown. At the outer end of each member 26', a connector plate 61' may be provided of slightly different configuration in order to accommodate the tilt or incline of flanges 43' with the ledge surface 67'. It will be readily apparent that the depth of the dome shaped or concave ceiling may be readily selected and varied by the initial adjustment of the suspension wires 39' of the central support member 24'.

In the angularly related connecting means 22' of FIG. 8, a fulcrum or pivot line 69 is provided by the bottom edge of wall 49 which defines opening 50', the fulcrum line 69 bearing against the top surface of edge portion 37'. When bolts 55' are tightened, because of the tolerance in opening 50' with respect to the thickness of portion 37', the bottom surface of portion 37' may contact the upper end edge of flanges 43'.

Connector plate 61' serves to interconnect adjacent members 26' and 59', plate 61' being provided with an inclined central section corresponding to the desired angle of member 26' to facilitate the connection.

In FIGS. 10–12 inclusive, suspended ceiling construction 20'' is illustrated as of convex configuration; that is, with the central support member 24'' spaced below the ledge surface 67''. In this example of the invention, each longitudinal structural member 26'' is of the same configuration as 26 and 26', but has been reversed end to end so that the previously described arcuate shaped opening 46'' is located at the outer periphery of the ceiling construction. The opposite end of longitudinal structural member 26'' is provided with a generally triangularly shaped opening 70 having an inclined or diagonal opening edge 71 and an inner edge 72 formed normal to flanges 43''. Web 42'' inwardly of edge 72 is received within slot 40'' of central support member 24'' and the edge portion 37'' of the support member is received within the opening 70 in selected angular relation. Nut and bolt assemblies 55'' secure the end of the longitudinal member 26'' to the central support plate. The arrangement of opening 70, slot 40'', and flanges 43'' provide an interconnecting and interlocking arrangement which limits lateral movement between members 24'' and 26'', restricts movement of member 26' to one direction only; that is, away from support member 24'' and permits relative vertical movement between the two members in the same fashion as the sector shaped opening 46 and 46' of the prior examples of the connecting means. Also cover plate 90'' may be cone-shaped to conform to the convex design.

In FIG. 11, the angular relation of members 24'' and 26'' is made about a pivot or fulcrum line 75 at the bottom peripheral edge of member 24'' and the top surfaces of flanges 43''.

At the opposite peripheral end of longitudinal member 26'', a connector plate 61'' may be employed to interconnect adjacent diverging ends of members 26'' and peripheral members 59''.

In the examples of the invention described above, longitudinal structural members 26, 26', 26'' have been shown as straight or lineal members. Such members 26, 26' 26'' may be curvilinear in relation to either vertical or lateral planes in order to achieve a desired design or aesthetic effect.

It will thus be apparent that connecting means 22 and the arrangement of longitudinal structural members 26, 26' and 26'' provide a readily adjustable connecting means for installing a suspended decorative ceiling construction in either a horizontal plane or in varying degrees of concavity or convexity.

The connecting means of the invention as described above also provides a novel method for installing the suspended ceiling construction. It will be understood that the suspension wires 33 may be connected to the ceiling and permitted to hang free in the selected vertical planes in which the longitudinal structural members 26' will be placed. Central support member 24 may be suspended from suspension wires 39 at an initial height to permit convenient interlocking of the longitudinal members 26 with the support member. As each longitudinal member 26 is assembled with the central support member 24, its peripheral end portion may be rested upon the ledge surface 67 and the web 42 received within the radial slot 40 of the central support member 24. When the periphery of longitudinal members 26 have been interlocked in the above fashion with the central support, bolt and nut assemblies 55' loosely interconnecting the flanges 43 and the peripheral edge portion 37, and the outer peripheral members 59 and connector plates 61 have been loosely interconnected with their bolt assemblies 64 and 65; the central support member 24 may be raised or lowered to the preselected desired height and configuration of the suspended ceiling construction. During raising or lowering of member 24, the plurality of radial members 26 are free to pivot about fulcrum 69 or 75 and will self-adjust to the selected final angular relation to provide uniform concavity or convexity in the ceiling construction. After fixing the height of central support member 24 by the suspension wires 39 to its final height, the nut and bolt assemblies 55' and 64' and 65' may be tightened to secure the entire framework of the suspended ceiling construction. Further, the suspension wires 33 may be interconnected to the webs 42 to provide additional support. After the structural framework of the suspended ceiling construction has been secured, panels 30 may be readily inserted through the openings between adjacent members 26 and manipulated so that they may lie and rest upon the flanges 43 of the structural members.

It will be readily apparent that the connecting means 22 of this invention which permits the ready relative adjustment of the relationship between the central support member and the longitudinal structural members 26 facilitates the installation of a decorative suspended ceiling of various configurations.

In the examples of the invention described above, the suspended ceiling construction has been shown as being of relatively circular or polygonal configuration. It will be understood that the connecting means 22 may also be used on a suspended ceiling construction of rectangular form in which the central support member may comprise an elongated ridge member provided with open ended slots along each longitudinal edge margin for coaction with ends of longitudinal structural members in the same manner as that described above between the central support member and longitudinal member 26. Such a ceiling may be shaped as an inverted V or as an upright V as where the central ridge member is lower than the supporting ledges at sides of the suspended ceiling construction.

Figure 13:
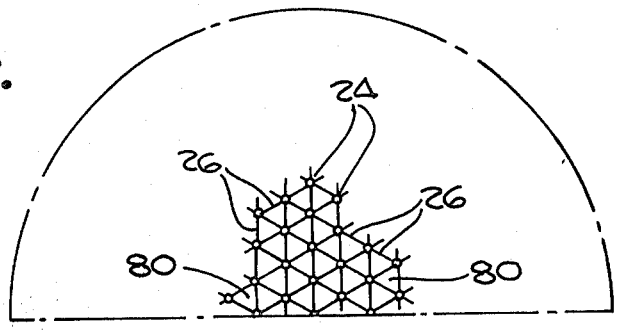
FIG. 13 is a schematic view of a geodesic construction in which the connecting means of this invention may be utilized.
Figure 13:
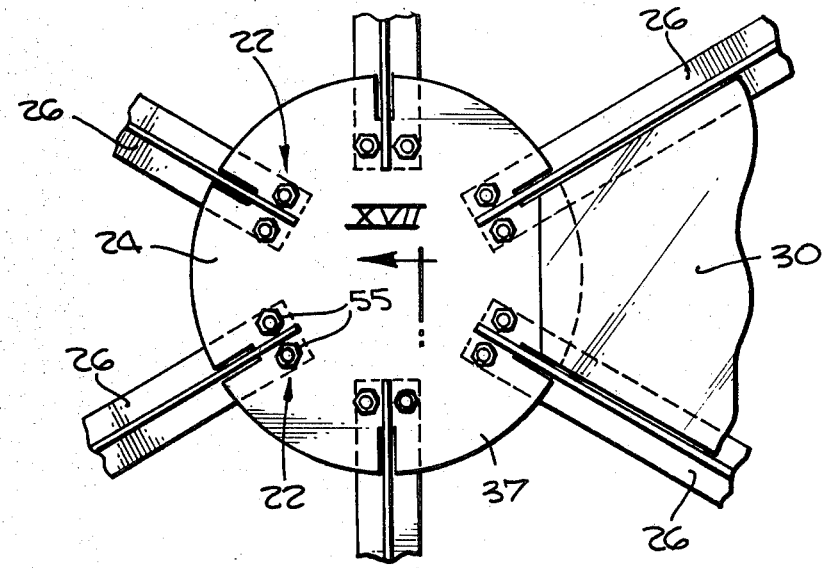
Figure 14:
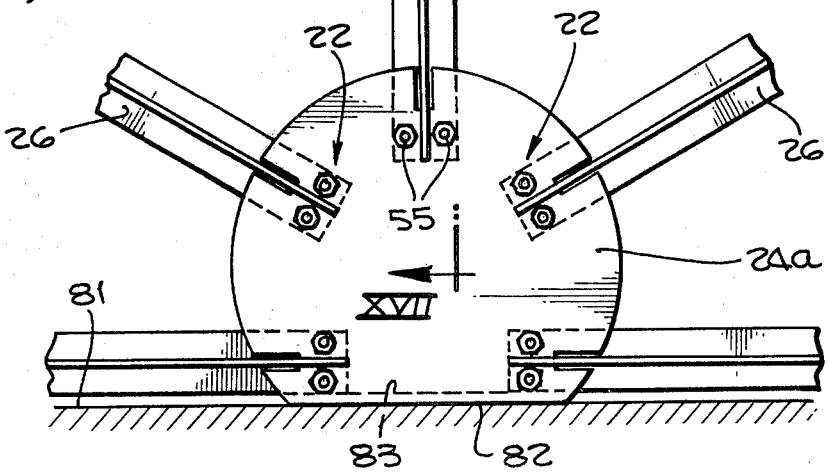
FIG. 14 is an enlarged fragmentary plan view of adjacent hubs and interconnecting elongate structural members of the geodesic construction shown in FIG. 13.
Figure 15:
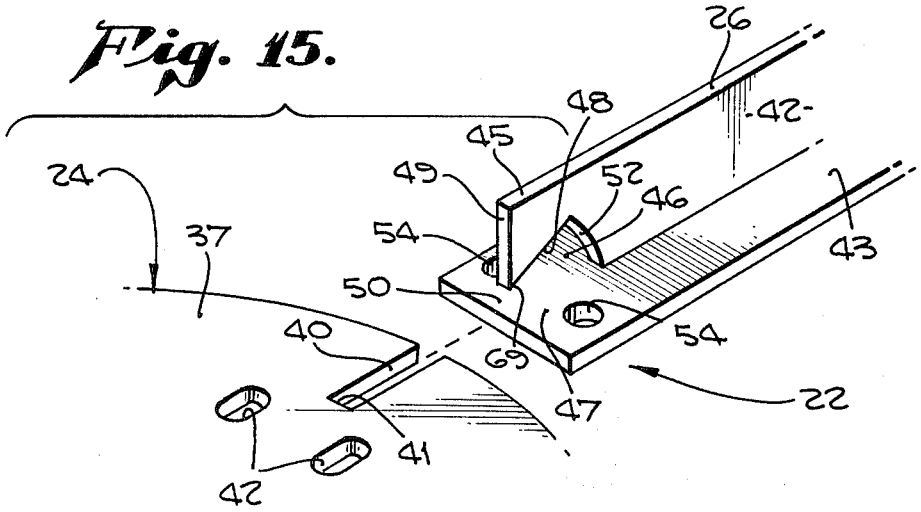
FIG. 15 is a fragmentary enlarged exploded perspective view of the connecting means of this invention.
Figure 16:
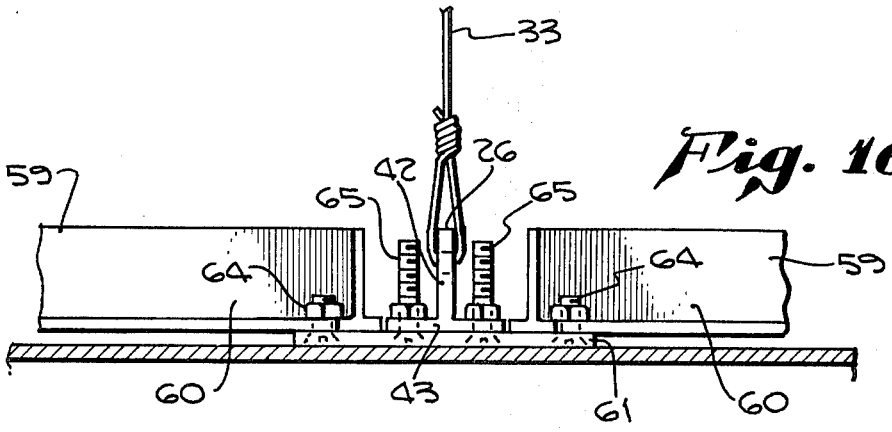
FIG. 16 is a fragmentary view taken from the plane indicated by line XVI—XVI of FIG. 4.
Figure 17:
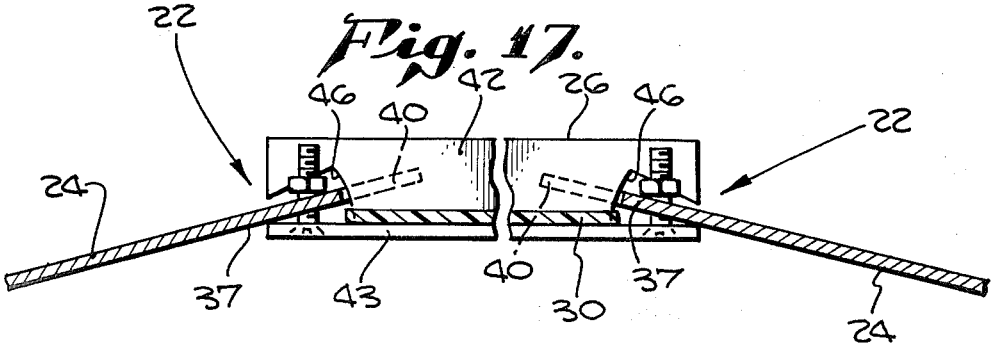
FIG. 17 is a fragmentary view of a geodesic structural member and connecting means of this invention taken in the plane indicated by line XVII—XVII of FIG. 14.

In FIGS. 13, 14, and 17, the novel interconnecting means 22 of this invention is illustrated in connection with a geodesic dome construction. In such geodesic dome constructions, the configuration of the dome is generally part-spherical and load bearing structural members are arranged in great circle patterns and comprise a plurality of spaced hub members and diagonally arranged members interconnecting the hub members to provide a network of triangular shaped openings. The theory of construction of a geodesic dome is described in Fuller U.S. Pat. No. 2,683,235 issued June 29, 1954.

As shown in FIG. 14, central support member 24 of circular form may serve as a hub member in such a geodesic construction to provide interconnection of a plurality of longitudinal structural members 26, in this instance six members, which will define with adjacent hub members 24 equilateral triangular openings 80. The connecting means 22 includes the slots 40 which receive webs 42 and the edge portions 37 of member 24 are received in sector shaped openings provided in web 42 at the end thereof as described in the prior examples of this invention. The angular adjustment features of connecting means 22 permit ready adaptability of the connecting means to the construction and erection of a geodesic dome as will be readily understood by those skilled in the art. In this example, the panels which cover the triangular openings 80 may be of corresponding triangular shape and may be supported on the flanges 43 of the longitudinal members 26, and secured and partially fitted under hub or connector plate 24 and sealed in place as is well known in the prior art.

Hub member 24*a*, which connects the dome construction to a base or foundation 81, may be suitably shaped as by providing a chord 82 with a flange 83 through which suitable anchor bolts may be installed. Other anchor means may be utilized.

In a geodesic dome construction utilizing the connecting means of this invention, it will be understood that the edge portion 37 may comprise a flange on a hub member of different construction than a circular disc in order to accept stresses and loads acting on such geodesic domes.

All changes and modifications made in the connecting means of this invention and coming within the scope of the appended claims are embraced thereby.

I claim:

1. A connecting means for structural members of a suspended ceiling construction which is supported at least at its periphery and its center, comprising in combination:

a central support member having an edge portion, said edge portion including a plurality of open ended slots;

a plurality of longitudinal structural members each having a vertically disposed web provided with flanges on opposite sides thereof and lying in a plane normal to the web, one end of said web having a sector shaped opening;

a web portion inwardly of said sector shaped opening being receivable within said slot, said sector shaped opening receiving said edge portion inwardly of the slot whereby such interengagement of said longitudinal structural member and said edge portion restricts relative lateral movement, relative longitudinal movement in one direction, and permits relative movement in a vertical direction of said support member and structural member;

and means securing said edge portion to said flanges in a selected relation.

2. A connecting means as stated in claim 1 wherein said sector shaped opening has an included angle of 30° for providing a selected angular relation between said support member and said structural member from 0°–30°.

3. A connecting means as stated in claim 1 wherein the other end of said web of said longitudinal structural member includes an opening decreasing in width from the end edge of said web for reception of said edge portion of the support member when said structural member is angularly related to said support member to provide a convex configured suspended ceiling construction.

4. A connecting means as stated in claim 1 including support means for the end of said longitudinal structural members at the periphery of the suspended ceiling construction, said support means including a ledge;

and means interconnecting adjacent ends of said longitudinal structural members at said ledge.

5. A connecting means as stated in claim 1 including a decorative panel supported on said flanges of said longitudinal structural members.

6. A connecting means for at least two structural members adapted to be arranged in a common plane or in angularly related planes:

means interconnecting said structural members for relative movement about a fulcrum on one member in a plane normal to said planes, for restricting relative lateral movement thereof, and for restricting relative longitudinal movement thereof in one direction of one of the members;

and means for securing said structural members in a selected relationship;

said means interconnecting said structural members including a web on one of said members lying in a plane passing through the longitudinal axis of said member;

a slot in the other structural member alignable with said plane of said web for reception of a portion of said web;

and a sector shaped opening in said web adapted to receive a portion of said other structural member, said portion lying in a plane normal to the plane of said web.

7. A connecting means as stated in claim 6 including means for securing said structural members in selected angular relationship;

said securement means including flanges on said one structural member adjacent said sector shaped opening and lying in a plane normal to the plane of said web; and fastening means extending through said flanges and said portion of said other structural member.

* * * * *

UNITED STATES PATENT AND TRADEMARK OFFICE

CERTIFICATE OF CORRECTION

PATENT NO. : 4,233,794

DATED : November 18,,1980

INVENTOR(S) : Ben Mayer

It is certified that error appears in the above—identified patent and that said Letters Patent is hereby corrected as shown below:

Column 6, line 50, "periphery" should read

-- plurality --.

Signed and Sealed this

*Seventeenth* Day of *February 1981*

[SEAL]

*Attest:*

RENE D. TEGTMEYER

*Attesting Officer*

*Acting Commissioner of Patents and Trademarks*